US011162691B2

(12) United States Patent
Nakamoto

(10) Patent No.: US 11,162,691 B2
(45) Date of Patent: Nov. 2, 2021

(54) CEILING-EMBEDDED AIR CONDITIONER

(71) Applicant: FUJITSU GENERAL LIMITED, Kawasaki (JP)

(72) Inventor: Takehiko Nakamoto, Kawasaki (JP)

(73) Assignee: FUJITSU GENERAL LIMITED, Kawasaki (JP)

( * ) Notice: Subject to any disclaimer, the term of this patent is extended or adjusted under 35 U.S.C. 154(b) by 338 days.

(21) Appl. No.: 14/879,448

(22) Filed: Oct. 9, 2015

(65) Prior Publication Data

US 2016/0102872 A1 Apr. 14, 2016

(30) Foreign Application Priority Data

Oct. 10, 2014 (JP) ..... JP2014-209379

(51) Int. Cl.
*F24F 1/0018* (2019.01)
*F24F 1/0047* (2019.01)
(Continued)

(52) U.S. Cl.
CPC ..... *F24F 1/0018* (2013.01); *F24F 1/0047* (2019.02); *F24F 1/0063* (2019.02);
(Continued)

(58) Field of Classification Search
CPC .. F24H 3/06; F04D 29/162; F24F 1/00; F24F 1/0003; F24F 1/0007; F24F 1/0011;
(Continued)

(56) References Cited

U.S. PATENT DOCUMENTS 6,470,699 B1 * 10/2002 Okuda ..... F24F 1/0007 62/259.2
6,877,331 B2 * 4/2005 Takeuchi ..... F24F 1/0007 62/259.1

(Continued)

FOREIGN PATENT DOCUMENTS

EP 2390590 B1 * 3/2017 ..... F24F 1/0047
GB 2314924 A * 1/1998 ..... F24F 1/0007

(Continued)

OTHER PUBLICATIONS

Machine Translation JP2010159909A (Year: 2010).*

*Primary Examiner* — Len Tran
*Assistant Examiner* — Gustavo A Hincapie Serna
(74) *Attorney, Agent, or Firm* — Manabu Kanesaka

(57) ABSTRACT

A ceiling-embedded air conditioner includes: a ceiling-embedded casing body; a turbo fan disposed inside the casing body; a heat exchanger disposed inside the casing body on an outer peripheral side of the turbo fan; and an electrical equipment box disposed along a part of the heat exchanger at the upstream side of a ventilation direction. The casing body has a square shape with first to fourth side plates. The heat exchanger has first to fourth heat exchange portions bent along the first to fourth side plates respectively. An end portion of the first heat exchange portion and an end portion of the fourth heat exchange portion are disposed at a corner for tube connection out of the four corners of the casing body. The electrical equipment box is disposed to extend from the corner for tube connection toward the first heat exchange portion and the fourth heat exchange portion.

4 Claims, 4 Drawing Sheets

(51) Int. Cl.
*F24F 1/0063* (2019.01)
*F24F 1/0067* (2019.01)
*F24F 13/06* (2006.01)
*F24F 1/0022* (2019.01)

(52) U.S. Cl.
CPC ..... *F24F 1/0067* (2019.02); *F24F 1/0022* (2013.01); *F24F 2013/0616* (2013.01)

(58) Field of Classification Search
CPC ..... F24F 1/0014; F24F 1/0022; F24F 1/0025; F24F 1/0059; F24F 2001/0037; F24F 2001/0074; F24F 2001/0081; F24F 2013/205
USPC ..... 165/122, 125, 126
See application file for complete search history.

(56) References Cited

U.S. PATENT DOCUMENTS 8,104,502 B2 * 1/2012 Nakata ..... F24F 1/0007 137/268
2002/0152760 A1 * 10/2002 Okuda ..... F24F 1/0047 62/259.2
2008/0159848 A1 * 7/2008 Liu ..... F24F 1/0047 415/108
2010/0192610 A1 * 8/2010 Yoshitake ..... F24F 1/0047 62/291
2010/0287967 A1 * 11/2010 Sakashita ..... F24F 1/0007 62/303
2014/0231051 A1 * 8/2014 Cho ..... F24F 1/0007 165/121
2015/0201519 A1 * 7/2015 Kaneoya ..... H05K 7/1427 361/752
2016/0054010 A1 * 2/2016 Suhara ..... F24F 1/0007 62/426

FOREIGN PATENT DOCUMENTS

JP 11201496 A * 7/1999
JP 2001221455 A * 8/2001
JP 2006153452 A * 6/2006
JP 3928294 B2 * 6/2007
JP 4104629 B2 * 6/2008
JP 2010-78266 A 4/2010
JP 2010159909 A * 7/2010
JP 2011153749 A * 8/2011
JP 2013-164219 A 8/2013
JP 2013164219 A * 8/2013
JP 2017122525 A * 7/2017
WO WO-2007126072 A1 * 11/2007 ..... F24F 1/0047

* cited by examiner

CEILING-EMBEDDED AIR CONDITIONER

CROSS-REFERENCE TO RELATED APPLICATION

This application claims priority from Japanese Patent Application No. 2014-209379 filed with the Japan Patent Office on Oct. 10, 2014, the entire content of which is hereby incorporated by reference.

BACKGROUND

1. Technical Field

The present disclosure relates to a ceiling-embedded air conditioner. More specifically, the present disclosure relates to an attachment structure of an electrical equipment box.

2. Description of the Related Art

The ceiling-embedded air conditioner has a casing body including a heat exchanger and a blower (turbo fan). The casing body is embedded in a space formed between a ceiling slab and a ceiling panel. A flat square decorative panel is attached to the lower surface of the casing body. The decorative panel has an air inlet and an air outlet.

An air inlet is disposed at the center of a decorative panel. Rectangular air outlets are disposed to surround the four sides of the air inlet. A suction grill with a dedusting filter is provided at the air inlet of the decorative panel.

In the configuration described in JP-A-2010-78266, the casing body is a cuboid in shape. The turbo fan is disposed at the center of the casing body. The heat exchanger is disposed to surround the outer periphery of the turbo fan. A bell-mouth is provided between the air inlet and the turbo fan. The bell-mouth guides the air, which is taken into the casing body from the air inlet, to the inside of the turbo fan.

The bell-mouth has a base portion and a suction guide portion. The base portion is formed in a square shape corresponding to the shape of the air inlet. The suction guide portion is formed in a trumpet shape from the center of the base portion toward the inside of the turbo fan. An electrical equipment box for storing electrical equipment is disposed at a part of the base portion (refer to JP-A-2010-78266, FIG. 2).

The known electrical equipment box is formed in an elongated cuboid shape. In addition, the known electrical equipment box is disposed along one side surface of a casing body such that the known electrical equipment box is partially exposed to the suction guide portion. Accordingly, the ventilation resistance becomes significantly larger near the side of the base portion with the electrical equipment box than the ventilation resistances in the vicinities of the three sides of the base portion without the electrical equipment box. This deteriorates a balance of the air passing through the heat exchanger.

According to another method disclosed in JP-A-2013-164219, an electrical equipment box is laid out at a corner of a bell-mouth (a bent portion of a heat exchanger) insusceptible to reduction in heat-exchange efficiency due to increased ventilation resistance. However, the heat exchanger is also disposed at the corner and the amount of an overlap between the heat exchanger and the electrical equipment box remains unchanged. This also results in an imbalance of the air passing through the heat exchanger.

SUMMARY

A ceiling-embedded air conditioner includes: a ceiling-embedded casing body that has an air suction path at the center of a lower surface and has an air blowoff path around the air suction path; a turbo fan that is disposed inside the casing body; a heat exchanger that is disposed inside the casing body on an outer peripheral side of the turbo fan; and an electrical equipment box that is disposed along a part of the heat exchanger at the upstream side of a ventilation direction. The casing body has a square shape with first to fourth side plates. The heat exchanger has first to fourth heat exchange portions bent along the first to fourth side plates respectively. An end portion of the first heat exchange portion and an end portion of the fourth heat exchange portion are disposed at a corner for tube connection out of the four corners of the casing body. The electrical equipment box is disposed to extend from the corner for tube connection toward the first heat exchange portion and the fourth heat exchange portion.

DESCRIPTION OF THE EMBODIMENTS

Figure 1:
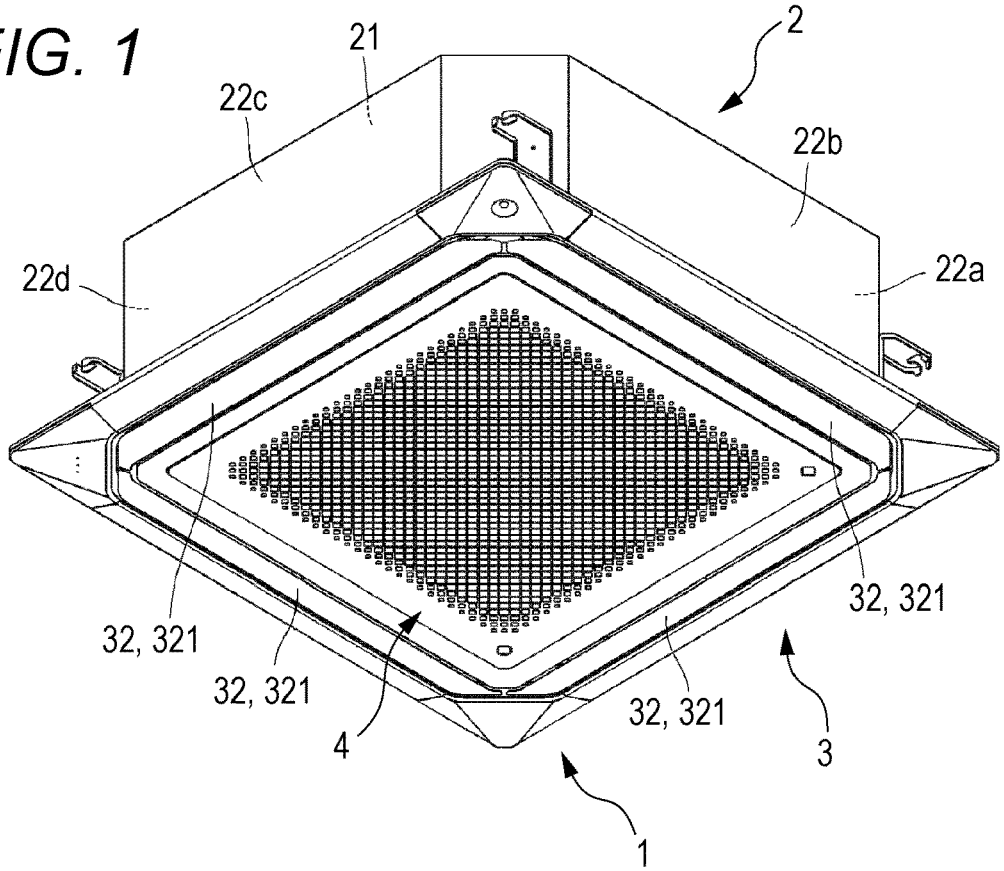
FIG. 1 is a perspective view of a casing body in a ceiling-embedded air conditioner according to an embodiment of the present disclosure as seen from the lower side.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

An object of the present disclosure is to provide a ceiling-embedded air conditioner as described below. That is, the ceiling-embedded air conditioner allows optimization of the structure and attachment position of an electrical equipment box. This attains a favorable balance of the air passing through the heat exchanger to suppress reduction in the efficiency of heat exchange.

A ceiling-embedded air conditioner (the air conditioner) according to an embodiment of the present disclosure includes: a ceiling-embedded casing body that has an air suction path at the center of a lower surface and has an air blowoff path around the air suction path; a turbo fan that is disposed inside the casing body; a heat exchanger that is disposed inside the casing body on an outer peripheral side of the turbo fan; and an electrical equipment box that is disposed along a part of the heat exchanger at the upstream side of a ventilation direction. The casing body has a square shape with first to fourth side plates. The heat exchanger has first to fourth heat exchange portions bent along the first to fourth side plates respectively. An end portion of the first heat exchange portion and an end portion of the fourth heat exchange portion are disposed at a corner for tube connection out of the four corners of the casing body. The electrical equipment box is disposed to extend from the corner for tube connection toward the first heat exchange portion and the fourth heat exchange portion.

As a preferable embodiment, the electrical equipment box is provided with first and second storage portions coupled to be orthogonal to each other and is formed in an L shape. The first storage portion is disposed from the corner for tube connection along the first heat exchange portion. The second storage portion is disposed from the corner for tube connection along the fourth heat exchange portion.

In addition, when a length of the first heat exchange portion is designated as L1, a length of the fourth heat exchange portion as L2, a length of the first storage portion as L3, and a length of the second storage portion as L4, the electrical equipment box is preferably formed to satisfy the following conditions:

$L3 \leq 1/2 \times L1$; and $L4 \leq 1/2 \times L2$.

Furthermore, the electrical equipment box preferably has a tapered surface at a corner between a top surface and a side surface exposed to a ventilation side.

According to the air conditioner, the electrical equipment box is disposed in an L shape along the heat exchange portions of the heat exchanger from the corner of the casing body as a starting point where the end portions of the heat exchanger are disposed at predetermined spacing therebetween. Accordingly, the portion of the electrical equipment box overlapping the heat exchanger can be split into right and left sides. This improves the balance of the air passing through the heat exchanger. As a result, it is possible to suppress reduction in the efficiency of heat exchange.

In addition, the electrical equipment box has the first and second storage portions orthogonal to each other. The electrical equipment box is formed in an L shape such that the first storage portion is disposed from the corner along the first heat exchange portion, and the second storage portion is disposed from the corner along the fourth heat exchange portion. This produces a favorable balance of the air passing through the heat exchanger. Accordingly, it is possible to minimize the influence on the heat exchange portions.

Further, when the length of the first heat exchange portion is designated as L1, the length of the fourth heat exchange portion as L2, the electrical equipment box is formed, the length of the first storage portion as L3, and the length of the second storage portion as L4, the electrical equipment box is formed to satisfy the following conditions:

$L3 \leq 1/2 \times L1$; and $L4 \leq 1/2 \times L2$.

This makes it possible to minimize the influence on the heat exchange portions while ensuring the required size of the electrical equipment box.

Furthermore, the tapered surface is provided at the corner of the electrical equipment box between the top surface and the side surface exposed to the ventilation side. Accordingly, the ventilation resistance of the air passing through the electrical equipment box is allowed to be suppressed. This prevents reduction in the efficiency of heat exchange.

Next, an embodiment of the present disclosure will be described with reference to the accompanying drawings. However, the present disclosure is not limited to this.

As illustrated in FIGS. 1 to 4, a ceiling-embedded air conditioner 1 includes a cuboid-shaped casing body 2. The cuboid-shaped casing body 2 is stored in the space formed between a ceiling slab and a ceiling panel. The casing body 2 is a box-shaped container having a top plate 21, four side plates 22*a* to 22*d* (hereinafter, referred to as first to fourth side plates 22*a* to 22*d*), and a bottom surface 20. The top plate 21 has a regular square shape with chamfered corners. The first to fourth side plates 22*a* to 22*d* are extended downward from the respective sides of the top plate 21. The bottom surface 20 (lower surface in FIG. 1) is opened. In this embodiment, the corners of the casing body 2 are chamfered according to the shape of the top plate 21.

The bottom surface 20 of the casing body 2 is opened to the inside of the room. An air suction path 23 that is square in cross section is formed at the center of the bottom surface 20. An air blowoff path 24 is formed on the bottom surface 20 of the casing body 2 to surround the four sides of the air suction path 23.

A decorative panel 3 is screwed to the bottom surface 20 of the casing body 2. The decorative panel 3 is made of a synthetic resin and has a flat regular square shape. A square air inlet 31 is provided at the center of the decorative panel 3. The air inlet 31 communicates with the air suction path 23 of the casing body 2. Rectangular air outlets 32 are disposed around the air inlet 31 at four places along the respective sides of the air inlet 31. The air outlets 32 communicate with the air blowoff path 24 at the back surface side (ceiling surface side).

A suction grill 4 is provided to cover the air inlet 31. The suction grill 4 is a synthetic resin molded component. The suction grill 4 is formed in a flat regular square shape to cover the bottom surface 20 of the casing body 2.

In this embodiment, the air outlets 32 are respectively covered with electrically opening and closing wind direction plates 321. During air-conditioning operation, the wind direction plates 321 are opened by a rotation member not illustrated provided on the back surface side of the decorative panel 3 to make the air outlets 32 appear.

The casing body 2 stores a turbo fan 5 as a blowing fan and a heat exchanger 6 therein. A bell-mouth 7 is disposed in the air suction path 23 ranging from the air inlet 31 to the turbo fan 5. The bell-mouth 7 guides the air taken in from the air inlet 31 to the turbo fan 5.

Figure 2:
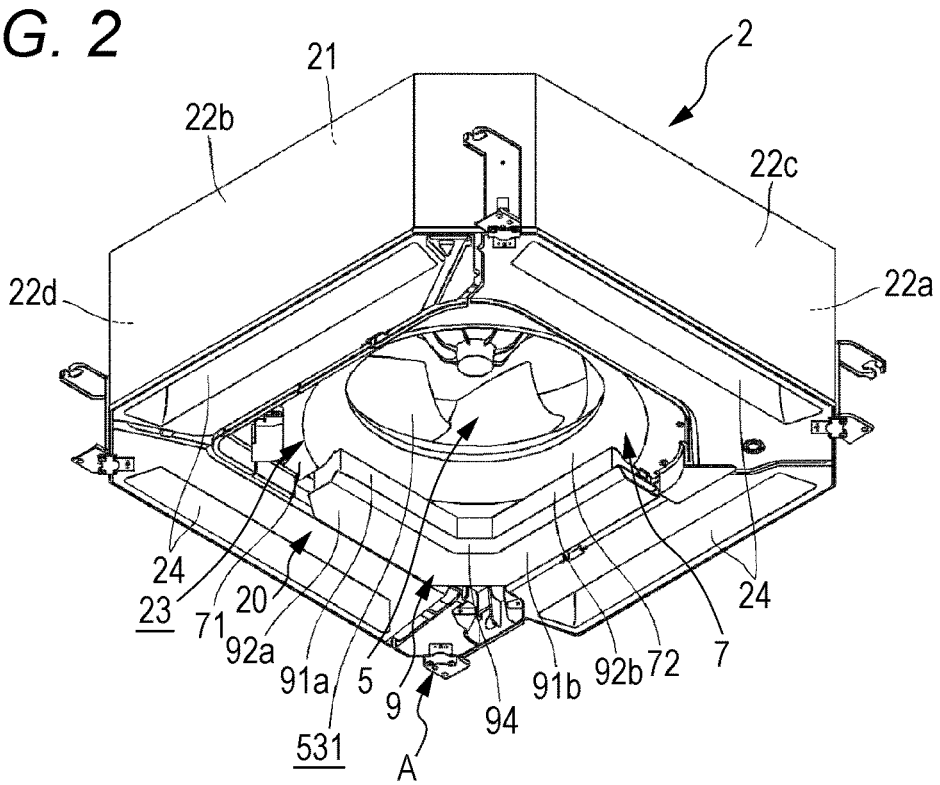
FIG. 2 is a perspective view of the state where a decorative panel is detached from the casing body illustrated in FIG. 1.
Figure 3:
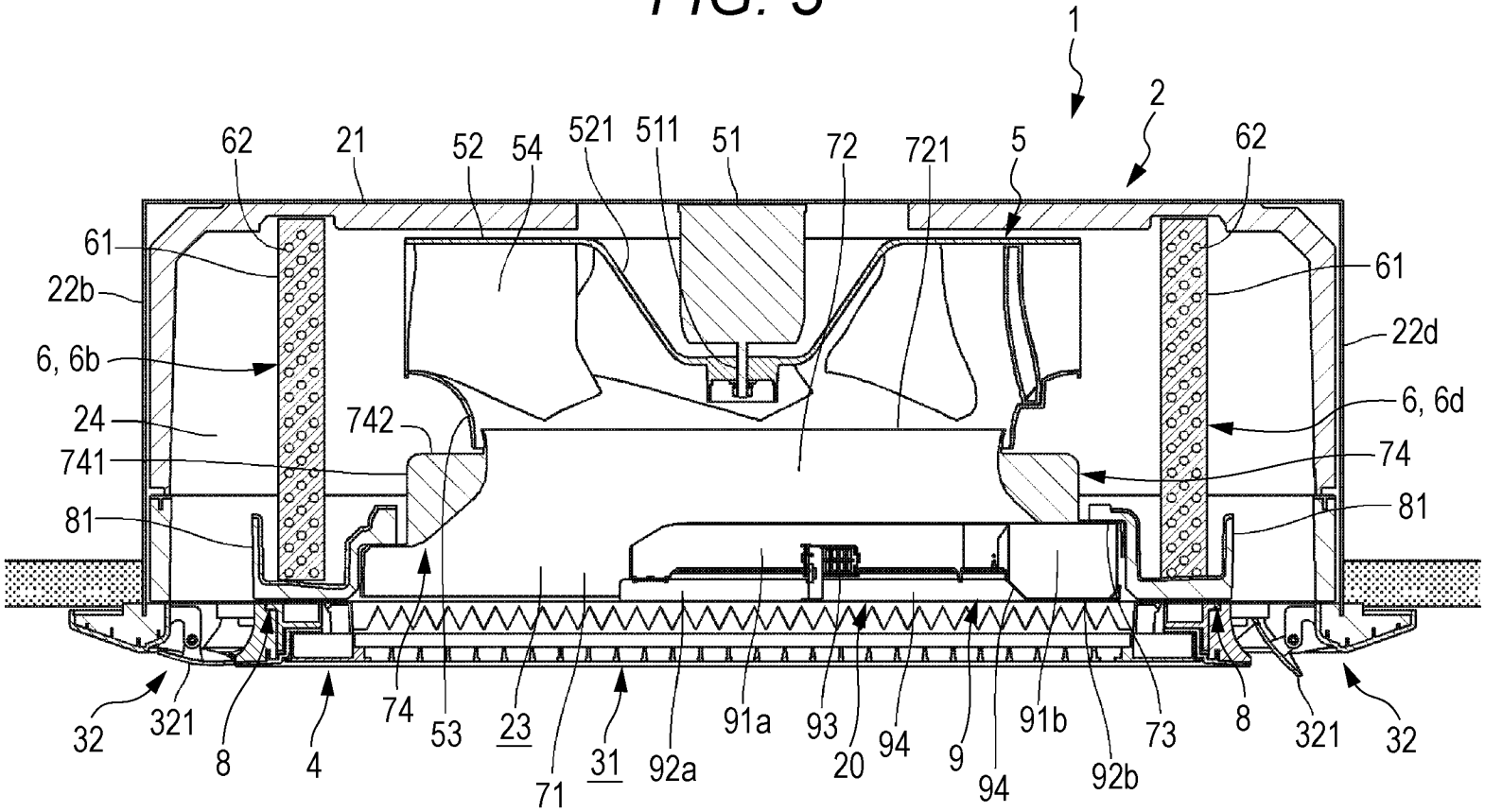
FIG. 3 is a cross-sectional view of an inner structure of the casing body.

As illustrated in FIGS. 2 and 3, the turbo fan 5 includes a main plate 52, a shroud 53, and a plurality of blades 54. The main plate 52 has a hub 521. A rotation shaft 511 of a drive motor 51 is fixed to the center of the hub 521. The shroud 53 is disposed to be opposed to the main plate 52 along the direction of axis of the rotation shaft 511. The plurality of blades 54 is disposed between the main plate 52 and the shroud 53. An opening 531 is provided at the center of the shroud 53 for inserting a part of the bell-mouth 7 into the turbo fan 5.

The turbo fan 5 is disposed at almost the center of inside of the casing body 2. The turbo fan 5 is hung and held by the drive motor (fan motor) 51 mounted on the top plate 21. Accordingly, as the turbo fan 5 is driven to rotate, the bell-mouth 7 is under negative pressure at the air inlet 31 side (lower side in FIG. 3). Therefore, the air taken in from the air inlet 31 is sucked into the turbo fan 5 through the bell-mouth 7, and is blown toward the outer peripheral direction through the blades 54.

Figure 4:
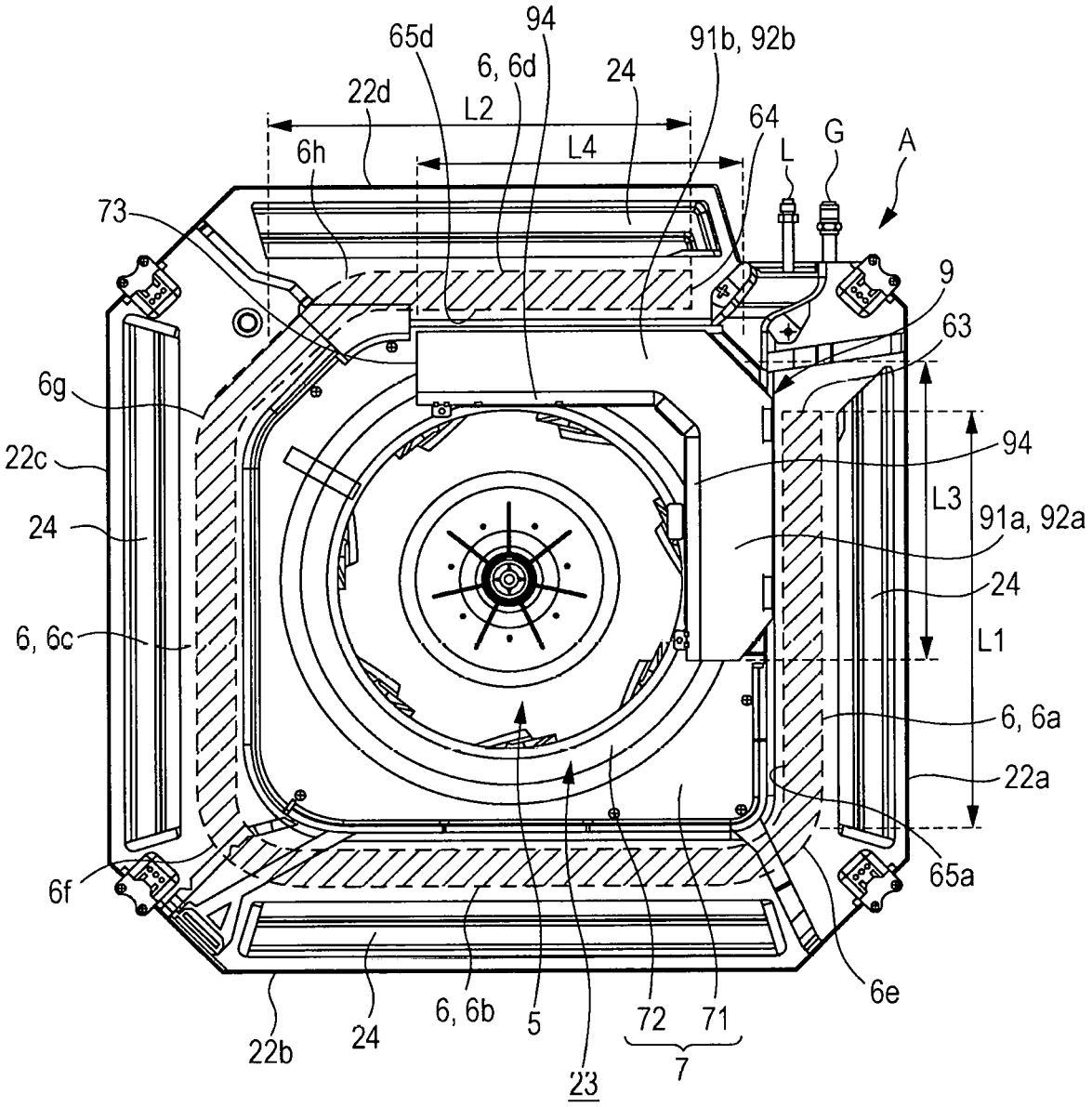
FIG. 4 is a bottom view describing the positional relation between a heat exchanger and an electrical equipment box.

As illustrated in FIGS. 3 and 4, the heat exchanger 6 is vertically extended from the top plate 21 to the opening in a bottom surface 20. The heat exchanger 6 is formed in a square frame shape to surround the turbo fan 5. The heat exchanger 6 has a first heat exchange portion 6*a*, a second heat exchange portion 6*b*, a third heat exchange portion 6*c*, and a fourth heat exchange portion 6*d*. The first heat exchange portion 6*a* is disposed in parallel to the first side plate 22*a*. The second heat exchange portion 6*b* is disposed in parallel to the second side plate 22*b*. The third heat exchange portion 6*c* is disposed in parallel to the third side plate 22*c*. The fourth heat exchange portion 6*d* is disposed in parallel to the fourth side plate 22*d*.

In this embodiment, the heat exchanger 6 includes an elongated square plate-like body with four bent portions. The heat exchanger 6 has a heat-radiation fin group 61 including a large number of strip-shaped heat-radiation fins. The large number of heat-radiation fins is disposed at predetermined spacing therebetween. In the heat exchanger 6, a large number of heat-transfer tubes 62 are inserted into the heat-radiation fin group 61 in parallel to one another.

As illustrated in FIG. 4, the heat exchanger 6 has four bent portions 6*e* to 6*h*. Of these bent portions, the first bent portion 6*e* is formed between the first heat exchange portion 6*a* and the second heat exchange portion 6*b*. The second bent portion 6*f* is formed between the second heat exchange portion 6*b* and the third heat exchange portion 6*c*. Each of the first bent portion 6*e* and the second bent portion 6*f* is bent at right angle.

The third bent portion 6*g* and the fourth bent portion 6*h* are positioned between the third heat exchange portion 6*c* and the fourth heat exchange portion 6*d*. In order to provide an installation space for a drain pump (not illustrated), the third bent portion 6*g* and the fourth bent portion 6*h* are bent such that, when the third bent portion 6*g* and the fourth bent portion 6*h* are combined with each other, a right angle or an approximately right angle is formed. The fourth bent portion 6*h* may not be provided between the third heat exchange portion 6*c* and the fourth heat exchange portion 6*d*. In this case, the third bent portion 6*g*, which is disposed between the third heat exchange portion 6*c* and the fourth heat exchange portion 6*d*, may be bent at right angle. Accordingly, the first to fourth heat exchange portions 6*a* to 6*d* are bent along the first to fourth side plates 22*a* to 22*d* of the casing body 2 respectively.

The end portions of the heat-transfer tubes 62 are drawn from an end portion 63 of the first heat exchange portion 6*a* and an end portion 64 of the fourth heat exchange portion 6*d* in the heat exchanger 6. A U-shaped tube (not illustrated) is coupled to the one end portion 63. At the other end portion 64, gas-side tubes are united into one collective tube and coupled to a gas-side pipe G, and liquid-side tubes are united into one collective tube and coupled to a liquid-side pipe L.

In this embodiment, the heat exchanger 6 is formed in a square shape in a plane view of FIG. 4 by bending one heat exchanger. Instead of this, the heat exchanger 6 may be formed by coupling four small-sized heat exchangers at the end portions.

As described above, the heat exchanger 6 is bent at the first to fourth bent portions 6*e* to 6*h*. Accordingly, the heat exchanger 6 is bent in a square shape. In addition, the heat exchanger 6 has the end portions 63 and 64 disposed at a predetermined spacing therebetween.

In this embodiment, as illustrated in FIG. 4, the end portions 63 and 64 are disposed at an upper right corner A for tube connection of the casing body 2. The gas-side pipe G and the liquid-side pipe L are drawn outward from the corner A of the casing body 2.

The heat exchanger 6 is connected to a reversible refrigeration cycle circuit not illustrated that allows cooling operation and heating operation. The heat exchanger 6 serves as an evaporator to cool the air during cooling operation. Meanwhile, the heat exchanger 6 serves as a condenser to heat the air during heating operation.

Drain pans 8 are provided at the lower end side of the heat exchanger 6 to receive dew condensation water generated by the heat exchanger 6. The drain pans 8 are provided with gutters 81. The gutters 81 store the lower end side of the heat exchanger 6. The dew condensation water dropped from the heat exchanger 6 is received at the gutters 81 and drawn up by a drain pump not illustrated.

The bell-mouth 7 is composed of a synthetic resin molded component. The bell-mouth 7 includes a base portion 71 and a suction guide portion 72 as illustrated in FIGS. 2 and 3. The bell-mouth 7 is screwed into the drain pans 8. The base portion 71 is disposed at the air inlet 31 side, and is formed in a square shape corresponding to the shape of the air inlet 31. The suction guide portion 72 is formed in a trumpet shape from the center of the base portion 71 toward the inside of the turbo fan 5.

The base portion 71 is a concave formed in a square shape corresponding to the shape of the air inlet 31. A storage concave portion 73, in which the electrical equipment box 9 described later is to be disposed, is formed in a part of the base portion 71. The storage concave portion 73 has a corner positioned above the corner A of the casing body 2 (refer to FIG. 2). The storage concave portion 73 is extended from the corner as a center in parallel to the first heat exchange portion 6*a* and the fourth heat exchange portion 6*d*. The electrical equipment box 9 is stored in the storage concave portion 73.

Figure 5:
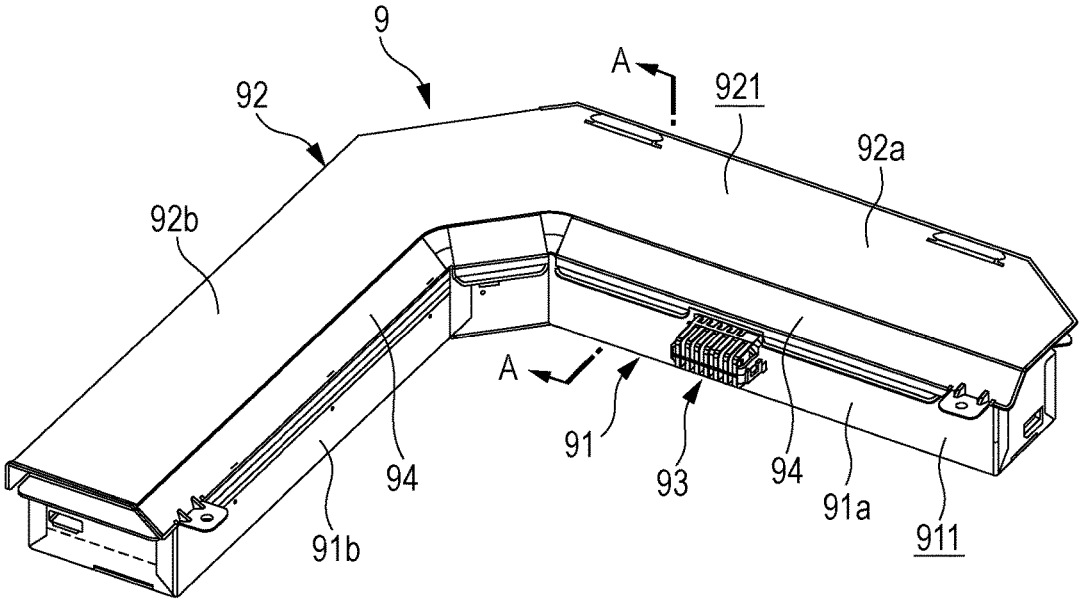
FIG. 5 is a perspective view of the electrical equipment box.
Figure 6:
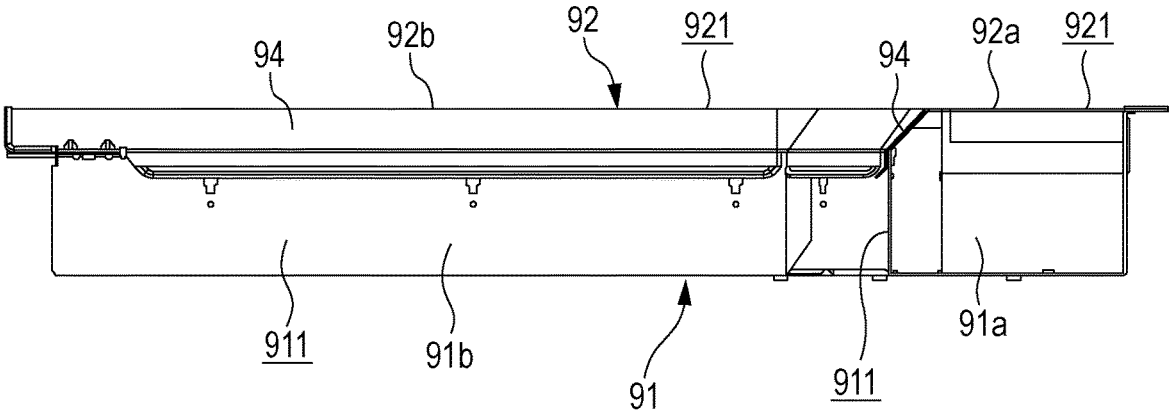
FIG. 6 is a cross-sectional view of the electrical equipment box illustrated in FIG. 5 taken along line A-A.

As illustrated in FIG. 4, the electrical equipment box 9 is disposed along a part of the heat exchanger 6 at the upstream side of the ventilation direction. As illustrated in FIGS. 5 and 6, the electrical equipment box 9 includes a box body 91 and a lid portion 92. The box body 91 has an opened upper surface and stores a substrate and/or electrical equipment (both not illustrated). The lid portion 92 closes the opened surface of the box body 91. In this embodiment, the electrical equipment box 9 is formed by bending a metal plate, for example.

The box body 91 has a first storage portion 91*a* and a second storage portion 91*b*. The box body 91 is formed in an L shape such that the first storage portion 91*a* and the second storage portion 91*b* are orthogonal to each other. A temperature-humidity sensor 93 is erected on the side wall of the first storage portion 91*a* opposed to the suction guide portion 72.

The lid portion 92 is formed in an L shape adapted to the opening of the box body 91. The lid portion 92 includes a first lid portion 92*a* covering the first storage portion 91*a* and a second lid portion 92*b* covering the second storage portion 91*b*. The lid portion 92 has a horizontal top surface 921 coinciding with the open surface of the box body 91. A tapered surface 94 is formed at the corner between the top surface 921 of the lid portion 92 and the side surface (a side surface exposed to the ventilation side) 911 of the box body 91 exposed to the suction guide portion 72.

The tapered surface 94 is an inclined surface that, when the electrical equipment box 9 is disposed at the storage concave portion 73 (refer to FIG. 3) of the bell-mouth 7, is formed at the corner between the top surface 921 of the lid portion 92 and the side surface 911 of the box body 91 exposed to the suction guide portion 72. The height of the tapered surface 94 (height in the up-down direction in FIG. 6) is gradually smaller from the upstream side to the downstream side of the ventilation direction. Accordingly, the air flowing along the surface of the electrical equipment box 9 can be smoothly guided toward the bell-mouth 7 through the tapered surface 94.

As illustrated in FIG. 4, the length of the first heat exchange portion 6*a* is designated as L1, the length of the fourth heat exchange portion 6*d* as L2, the length of first storage portion 91*a* as L3, and the length of the second storage portion 91*b* as L4. In this case, the electrical equipment box 9 is formed to satisfy the following conditions:

$L3 \leq 1/2 \times L1$; and $L4 \leq 1/2 \times L2$.

Accordingly, the amount of an overlap between the first heat exchange portion 6*a* and the first storage portion 91*a* and the amount of an overlap between the fourth heat exchange portion 6*d* and the second storage portion 91*b* become 50% or less respectively. This produces a favorable balance of the air passing through the heat exchanger while ensuring the required size of the electrical equipment box. As a result, it is possible to enhance the efficiency of heat exchange.

When the electrical equipment box 9 is disposed along the storage concave portion 73 of the bell-mouth 7, the first storage portion 91*a* is disposed from the corner A along an opposed surface 65*a* of the first heat exchange portion 6*a* (in parallel to the opposed surface 65*a*). Further, the second storage portion 91*b* is disposed from the corner A along an opposed surface 65*d* of the fourth heat exchange portion 6*d* (in parallel to the opposed surface 65*d*).

Accordingly, the electrical equipment box 9 is disposed from the corner A toward the first heat exchange portion 6*a* and the fourth heat exchange portion 6*d*. That is, the center of the electrical equipment box 9 is disposed at the corner A hardly contributing to heat exchange. In other words, the electrical equipment box 9 is disposed in an L shape from corner A as a starting point along the opposed surface 65*a* of the first heat exchange portion 6*a* and the opposed surface 65*d* of the fourth heat exchange portion 6*d*. This produces a favorable balance of the air passing through the heat exchanger.

According to this embodiment, the electrical equipment box 9 has the first storage portion 91*a* and the second storage portion 91*b* that are equal in length (L3:L4=1:1). The lengths (and the length ratio) of the first storage portion 91*a* and the second storage portion 91*b* may be arbitrarily changed according to the specifications as far as the foregoing conditions (L3≤1/2×L1 and L4≤1/2×L2) are satisfied.

As described above, according to the present disclosure, the electrical equipment box is disposed in an L shape along the heat exchange portions of the heat exchanger from the corner of the casing body as a starting point where the end portions of the heat exchanger are disposed at predetermined spacing therebetween. Accordingly, the portion of the electrical equipment box overlapping the heat exchanger can be split into right and left sides. This improves the balance of the air passing through the heat exchanger. As a result, it is possible to suppress reduction in the efficiency of heat exchange.

The expressions herein indicating shapes or states such as regular square, rectangular, square, circular, vertical, parallel, right angle, the same, orthogonal, and horizontal, signify not only strict shapes or states but also approximate shapes or states shifted from the strict shapes or states, without deviating from the scope in which the operations and effects of these shapes or states can be achieved.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A ceiling-embedded air conditioner comprising:

a ceiling-embedded casing body that has first to fourth side plates forming a square shape, a lower surface arranged below the first to fourth side plates, an air suction path at a center of the lower surface, and an air blowoff path around the air suction path, one corner of four corners of the casing body having a gas-side pipe and liquid side tubes and being arranged for tube connection;

a bell-mouth disposed in the lower surface of the casing body and including a concaved base portion having a square shape with a flat bottom and a suction guide portion in a center of the concaved base portion, the concaved base portion with the flat bottom having an L-shape storage portion formed in the square shape wherein a corner of the L-shaped storage portion is positioned on the one corner of the casing body;

a turbo fan that is disposed inside the casing body;

a heat exchanger that is disposed inside the casing body on an outer peripheral side of the turbo fan and has heat-transfer tubes therein, first to fourth heat exchange portions bent along the first to fourth side plates respectively, an end of the first heat exchange portion and an end of the fourth heat exchange portion, the ends of the first and fourth heat exchange portions being spaced from each other and disposed at the one corner of the four corners of the casing body, the storage portion extending from the one corner as a center in parallel to the first heat exchange portion and the fourth heat exchange portion;

drain pans formed separately from the bell-mouth and disposed laterally outside the concaved base portion of the bell-mouth at lower ends of the first to fourth heat exchange portions; and an electrical equipment box that is disposed in the L-shape storage portion of the concaved base portion along a part of the heat exchanger at an upstream side of a ventilation direction, and includes a first storage portion disposed to extend from inside the one corner along the first heat exchange portion and having a length less than that of the first heat exchange portion, a second storage portion disposed to extend from inside the one corner along the fourth heat exchange portion and having a length less than that of the fourth heat exchange portion, and a corner portion coupling the first and second storage portions to be orthogonal to each other to form an L-shape and disposed at said one corner for connection of the gas-side pipe and the liquid side tubes where the first and the fourth heat exchange portions are not present, wherein an outer line of the first storage portion along the first heat exchange portion extends beyond the end of the first heat exchange portion to the one corner for the tube connection, and an outer line of the second storage portion along the fourth heat exchange portion extends beyond the end of the fourth heat exchange portion to the one corner for the tube connection so that a center of the electrical equipment box is disposed at the one corner of the casing body, the one corner hardly contributing to heat exchange, wherein the electrical equipment box has a tapered surface at a corner between a top surface of the electrical equipment box and a side surface of the electrical equipment box exposed to a ventilation side, and wherein the tapered surface also extends beyond the ends of the first and fourth heat exchange portions until the one corner for the casing body.

2. The ceiling-embedded air conditioner according to claim 1, wherein when the length of the first heat exchange portion is designated as L1, the length of the fourth heat exchange portion as L2, the length of the first storage portion as L3, and the length of the second storage portion as L4, the electrical equipment box is formed to satisfy the following conditions:

$L3 \leq 1/2 \times L1$; and $L4 \leq 1/2 \times L2$.

3. The ceiling-embedded air conditioner according to claim 1, wherein the first storage portion has the length same as that of the second storage portion.

4. The ceiling-embedded air conditioner according to claim 1, wherein the suction guide portion disposed at a center of the concaved base portion extends toward the turbo fan, the suction guide portion having a trumpet shape with an inner opening and guiding the air to the turbo fan, the electrical equipment box being arranged outside the inner opening.

* * * * *